US010870126B2

(12) United States Patent
Ferrari

(10) Patent No.: US 10,870,126 B2
(45) Date of Patent: Dec. 22, 2020

(54) PRINTING APPARATUS AND CORRESPONDING METHOD

(71) Applicant: JET-SET S.R.L., Imola (IT)

(72) Inventor: Sergio Ferrari, Ponte San Pietro (IT)

(73) Assignee: JET-SET S.R.L., Imola (IT)

( * ) Notice: Subject to any disclaimer, the term of this patent is extended or adjusted under 35 U.S.C. 154(b) by 120 days.

(21) Appl. No.: 15/908,627

(22) Filed: Feb. 28, 2018

(65) Prior Publication Data

US 2018/0243785 A1 Aug. 30, 2018

(30) Foreign Application Priority Data

Feb. 28, 2017 (IT) ..... 102017000022142

(51) Int. Cl.

| | |
|---|---|
| ***B41J 25/304*** | (2006.01) |
| ***B05C 11/00*** | (2006.01) |
| ***B05C 13/00*** | (2006.01) |
| ***B05C 5/02*** | (2006.01) |
| ***B05D 1/26*** | (2006.01) |
| ***B41J 2/165*** | (2006.01) |

(52) U.S. Cl.

CPC ..... *B05C 11/00* (2013.01); *B05C 5/0208* (2013.01); *B05C 13/00* (2013.01); *B05D 1/26* (2013.01); *B41J 2/16505* (2013.01); *B41J 2/16511* (2013.01); *B41J 2/16585* (2013.01); *B41J 25/304* (2013.01)

(58) Field of Classification Search

CPC . B41J 29/13; B41J 29/56; B41J 29/377; B41J 2/14024; B41J 2202/20; B41J 2/17526; B41J 2/17523; B41J 2/175; B41J 25/304

See application file for complete search history.

(56) References Cited

U.S. PATENT DOCUMENTS

| | | | | |
|---|---|---|---|---|
| 2003/0081053 | A1 | 5/2003 | Barinaga et al. | |
| 2005/0156975 | A1* | 7/2005 | Inoue | B41J 3/543 347/13 |
| 2006/0274108 | A1* | 12/2006 | Shimizu | B41J 2/16585 347/22 |
| 2011/0242195 | A1* | 10/2011 | Sugimoto | B41J 2/16511 347/20 |

FOREIGN PATENT DOCUMENTS

DE 102014111466 A1 2/2016

* cited by examiner

*Primary Examiner* — Kristal Feggins

(74) *Attorney, Agent, or Firm* — Marshall, Gerstein & Borun LLP

(57) ABSTRACT

A printing apparatus includes a support plane to support at least a print support; at least two printing groups aligned along a longitudinal axis, and each provided with at least a printing head; a support structure provided to support said printing groups above said support plane, at least a moving device to move said printing groups towards/away with respect to said support plane, at least two containment devices each associated with respective positioning means, and configured to collect printing liquid form said printing heads.

9 Claims, 6 Drawing Sheets

PRINTING APPARATUS AND CORRESPONDING METHOD

FIELD OF THE INVENTION

The present invention relates to the technical field of printing apparatuses for printing on substrates such as paper, cardboard, textiles, metal, wood, plastics, mineral materials, ceramic or such-like. In particular, the present invention relates to an apparatus and a method for the temporary protection of printing heads, at least during downtimes, and tools or parts of said printing apparatus.

BACKGROUND OF THE INVENTION

In the art, printing apparatuses are known comprising a support and conveying plane, usually a conveyor belt, on which substrates to be printed are placed and conveyed.

Such apparatuses generally comprise a plurality of printing groups, each provided with a plurality of printing heads, intended to print a print substrate with one or more printing liquids.

Such printing liquid can comprise at least one among paint, ink, or other kinds of enhancing materials. Such printing liquids can also comprise one or more additives, like metallized additive, glitter or such like. Enhancing materials can be contained in tanks, each dedicated to a distinct color, paint or enhancing material. Said printing liquid is channeled, through feed devices, and optionally recirculating devices, from its relative tank to at least a printing head.

In the art, the drawback is known that printing liquids tend to ooze from printing heads when they are inactive, and printing heads insulation from environment is needed both to protect them and to prevent undesired oozing of printing liquids under printing heads themselves. This because some printing liquids (e.g. UV. inks) are toxic for human skin, and therefore any contact should be prevented. Moreover, also the soiling of apparatus parts adjacent to printing heads has to be prevented.

Moreover, during downtimes when in contact with air, some kinds of printing liquids tend to evaporate or dry, irreparably damaging printing heads. This requires printing heads replacement, which is costly both due to the intrinsic cost of the printing heads, and to the difficulty of accessing printing heads for replacement.

Closing systems for printing heads, making use of trays, are known in the art; nonetheless, such systems have the drawback of closing all the printing heads of a printing apparatus. Moreover, they require spaces in the apparatus for their storage when not in use.

Other printing apparatus are disclosed in US-A-2003/081053, US-A-2011/242195 and DE-A-10.2014.111466.

In particular, US-A-20037081053 discloses a print unit including a wiper assembly and a print assembly to deposit an imaging medium onto a print media. In particular, the print assembly is provided with a plurality of printing heads aligned along a longitudinal axis and can be moved towards or away with respect to the print media in an orthogonal direction with respect to the longitudinal axis.

The wiper assembly has a support structure that couples the wiper assembly to a positioning mechanism. On the support mechanism wipers are installed, distanced with respect to each other and with a distance equal to the distance between two adjacent printbar assemblies. The positioning mechanism moves the wiper assembly in a direction that is parallel with respect to said longitudinal axis, in order to dispose each wiper of the wiper assembly in correspondence to one of the printing head, when a cleaning of the latter are required, or in an area comprised between two adjacent printbar assemblies, when the printbar assemblies are in a printing condition.

The wiper assembly is also provided with caps to cover the printing heads. The caps prevent ink in the nozzles of the printing heads from drying when the printer is sitting idle. In order to position the caps in proximity to the printing heads for the purpose of engaging the print heads and the caps, the wiper assembly is designed to rotate about a central longitudinal axis. When wiper assembly is rotated about axis, and the caps are positioned to engage the printing heads, either the wiper assembly and/or the printbar assembly can be moved in relation to the other to engage and cover the printing heads with the caps.

This known solution however is particularly complex to make and to manage. Moreover, between each couple of printing assemblies, a large parking area should be provided, in order to position the wipers, and the caps in their inactive position. This known solution therefore is very bulky.

Other printing apparatus provided with a cleaning unit for the print heads are disclosed in US-A-2011/242195 and DE-A-10.2014.111466, but also these solutions are very complicated and are not suitable for industrial applications.

Aim of the present invention is providing a printing apparatus preserving the features of the printing liquid in the printing heads even following a prolonged downtime of the printing apparatus.

A further purpose of the present invention is to make a printing apparatus which is simple and compact with respect to the number of printing groups.

A further aim of the present invention is providing a printing apparatus allowing to prolong the duration of a conventional printing apparatus.

A further aim of the present invention is providing a printing apparatus limiting the start time of the printing process.

A further aim of the present invention is increasing the efficiency and the versatility of a printing apparatus, e.g. allowing to perform the printing of a print substrate with one printing group only, keeping the other printing groups in a non-use condition.

A still further aim of the present invention is reducing the waste of printing liquids required e.g. at the start of the printing apparatus after a prolonged downtime.

These and other aims of the present invention, which will become apparent from the following description, are obtained with an apparatus and a method having the features of the independent claims. Advantageous embodiments and refinements are specified in claims dependent thereon.

SUMMARY OF THE INVENTION

According with the above-mentioned aims, a printing apparatus according to the present invention comprises:

a support plane to support at least a print substrate, or print support;

at least two printing groups, aligned along a longitudinal axis and each provided with at least one printing head;

a support structure provided to support said printing groups above the support plane;

at least a moving device to move said printing groups towards or away with respect to said support plane at least two containment devices, each associated with respective positioning means.

Said positioning means are configured to selectively move, independently with respect to each other and in a parallel direction with respect to the longitudinal axis, the respective containment device at least in a first operative position, in which said containment device is positioned under said at least one printing head of one of the printing groups, and in a second inactive position in which the containment device is in a position not interfering with the working of the printing group and with the movement of the printing group towards or away with respect to the support plane.

According to an aspect of the present invention, the containment devices are disposed on parallel and distanced lying planes and, in the second inactive position, the containment devices are superimposed to each other, so as to reduce their overall encumbrance. In this way a printing apparatus, having the same number of printing heads, can be obtained with a length that is shorter with respect to known printing apparatuses. The particular configuration of the present application, moreover, allows to simplify the constructional parts of supporting the containment devices and to obtain a very simple device.

In a preferred embodiment, in their second inactive position the containment devices are placed in an intermediate position between two adjacent printing groups.

In this way, when said containment devices are in their first operative position, or collecting position, they can at least collect the printing liquid oozing from printing heads, while in their second inactive position, the containment devices are positioned outside the working space of printing heads, allowing the printing of print supports on the support plane.

Moreover, the presence of independent positioning means for positioning the containment devices allows to bring, separately and in a selectively desired way, the containment devices in their first collecting operative position and in their second inactive position. This optionally allows to print with one printing head only, while the other printing head is closed by its respective containment device, and there is no oozing of the printing liquid towards the print support.

Moreover, the particular embodiment of the present invention allows to protect the support plane on which print supports lie, which does not undergo the falling of printing/cleaning liquids, and therefore lasts longer over time.

According to a possible embodiment, at least one, or all, the containment devices can be provided with seals or gaskets suitable for hermetically sealing printing heads when the containment device is in its first collecting operative position. In this way, should the printing apparatus use air-sensitive printing liquids, both the dispersion in the environment and the drying of printing liquids inside printing heads with ensuing respective damages can be prevented.

Moreover, thanks to the hermetic closing of printing heads (capping), a further advantage derives from the fact that, at least in the initial printing phase, it is possible to reduce up to eliminate the quantity of printing liquid needed for the flushing of printing heads. The capping makes the re-start of printing heads much more rapid, and consequently cheap. In particular, given the modularity of the containment devices, one or more printing heads can be closed and the closed printing heads can be flushed, while the other printing heads continue to print: this renders the set-up of the printing apparatus much more rapid.

Embodiments of the present invention also relate to a printing method which comprises: positioning a print support on a support plane, and printing respective printing liquids on the print support with at least two printing groups, each provided with at least a printing head.

Said printing groups are aligned along a longitudinal axis and are moved towards/away with respect to the support plane with at least a moving device. Two containment devices are selectively and independently positioned, by means of positioning means, at least in a first operative position in which said containment device is positioned under at least one printing head of one of the printing groups, and in a second inactive position in which the containment device is in a position non-interfering with the movement of the printing group towards or away with respect to the support plane.

According to an aspect of the method of the present invention, the containment devices are disposed on parallel and distanced lying planes and, in the second inactive position, said containment devices are superimposed to each other.

According to a possible implementation of the method, in the first operative position, at least one of the printing groups is lowered towards its respective containment device in order to position at least its printing head inside the containment device.

BRIEF DESCRIPTION OF THE DRAWINGS

Further advantages and features of the present invention are disclosed in the following description, in which exemplary embodiments of the present invention are explained in detail based on the drawing.

DETAILED DESCRIPTION OF SOME EMBODIMENTS

The Figures show possible embodiments of a printing apparatus, according to the present invention, to print at least one printing liquid on a substrate.

Figure 1:
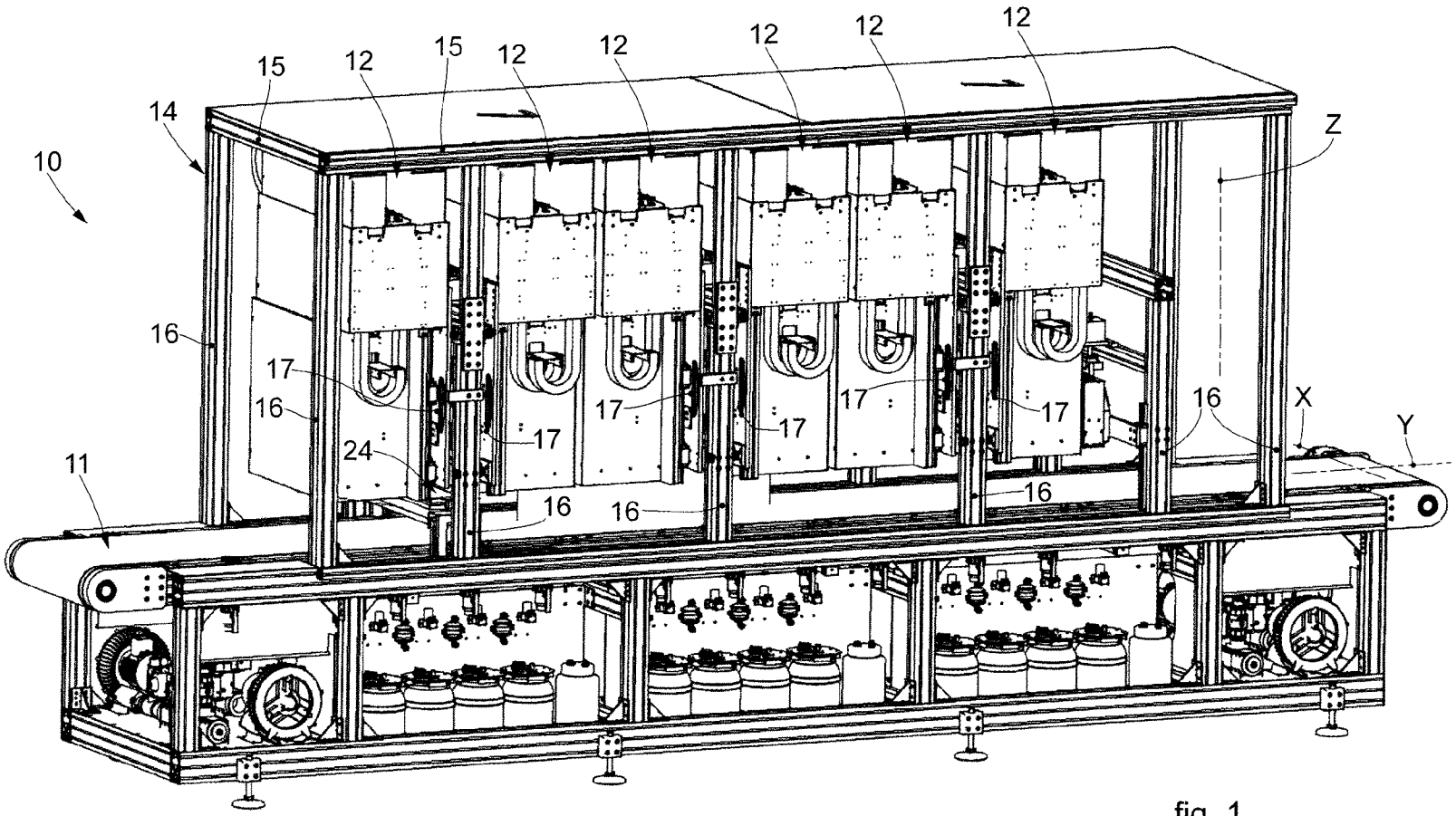
FIG. 1 is an axonometric view of a printing apparatus.
Figure 9:
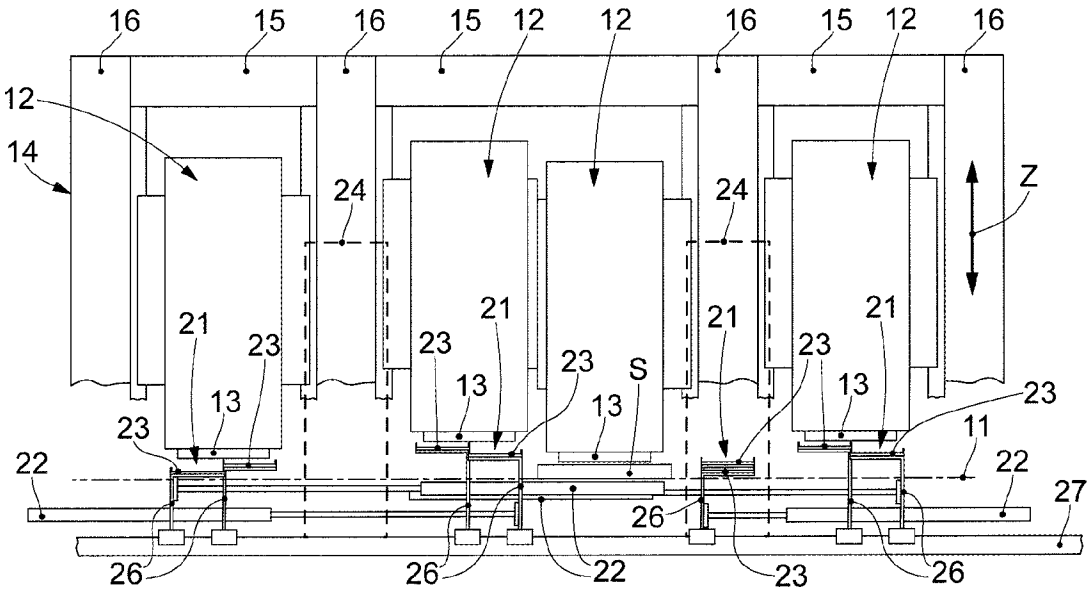
FIG. 9 is a schematic view of the printing apparatus with containment devices in a second inactive position.

FIG. 1 shows a printing apparatus 10, according to the present invention, comprising a support plane 11, in particular a conveyor for supporting and conveying one or more print substrates S, or print support to be printed (FIG. 9).

Moreover, said printing apparatus 10 comprises at least two printing groups 12, each provided with at least a printing head 13 for printing a printing liquid on said print support S.

Figure 8:
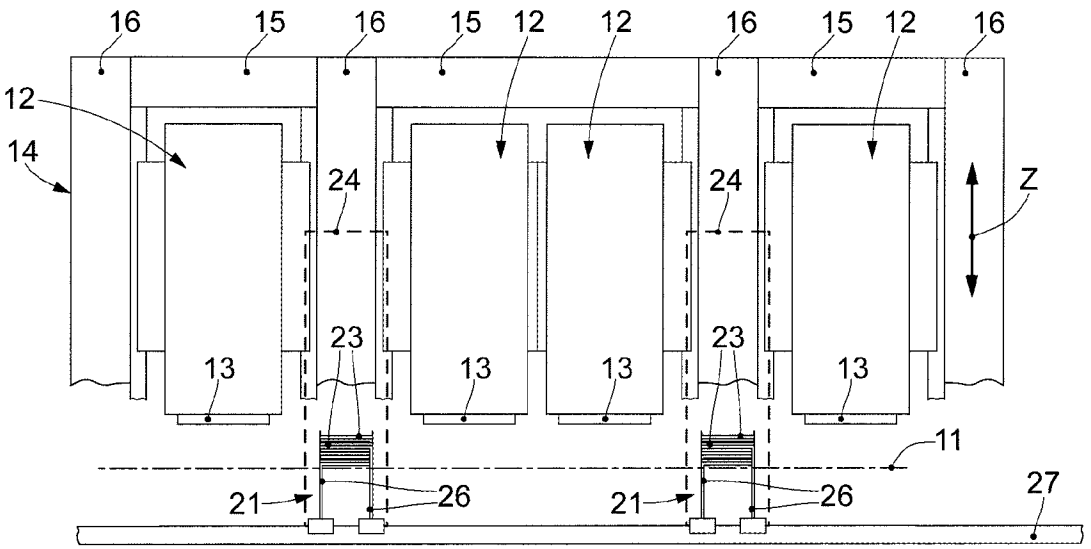
FIG. 8 is a schematic view of the printing apparatus with containment devices in a first operative condition.

In the case illustrated in FIG. 1, said printing apparatus 10 comprises six printing groups 12, while in the FIGS. 8 and 9 said printing apparatus 10 comprises four printing groups 12.

With reference to FIG. 1, and from left to right, the first and the last printing group 12 are also denominated in the art printing half-bridges, while the pairs of printing groups 12 comprised between the two printing half-bridges are also called in the art printing bridges, which in turn are defined each by two printing half-bridges.

Analogously, with reference to FIGS. 8 and 9, the printing apparatus 10 comprises two printing half-bridges and one printing bridge with two half-bridges.

According to a possible embodiment of the present invention, the printing groups 12 are placed in sequence aligned along a longitudinal axis Y (FIG. 1).

In the case in which the support plane 11 is defined by a conveyor, the longitudinal axis Y corresponds to the direction of movement of the print supports S along the conveyor itself.

According to a further aspect of the present invention, the printing apparatus 10 comprises a support structure 14 to support said printing groups 12 above the support plane 11.

According to possible embodiments of the present invention, the support structure 14 is defined by a plurality of crossbeams 15 placed above the support plane 11 and supported by uprights 16.

At least some of the uprights 16 can be interposed between two printing groups 12, as illustrated in FIGS. 1, 8 and 9.

To each printing group 12 moving devices 17 are associated, provided to move said printing groups 12, with respect to the support structure 14, towards or away with respect to the support plane 11, approaching/distancing it to/from the latter.

In particular, during the printing process, the moving devices 17 bring the printing group 12 in an active condition wherein the printing heads 13 are in printing condition on the print support S, while in the non-active condition said printing heads are distanced from the support plane 11.

According to a possible embodiment, the moving devices 17 are configured to move said printing groups 12 in a moving direction Z which is incident, usually orthogonal, with respect to the support plane 11, and orthogonal to said longitudinal axis Y.

Each printing group 12, in addition to the printing heads 13, can comprise at least one between a containment tank of the printing liquid, a feed device of the printing liquid from said tank to the printing head, a recirculating device of said printing liquid, or a combination of the latters.

Figure 2:
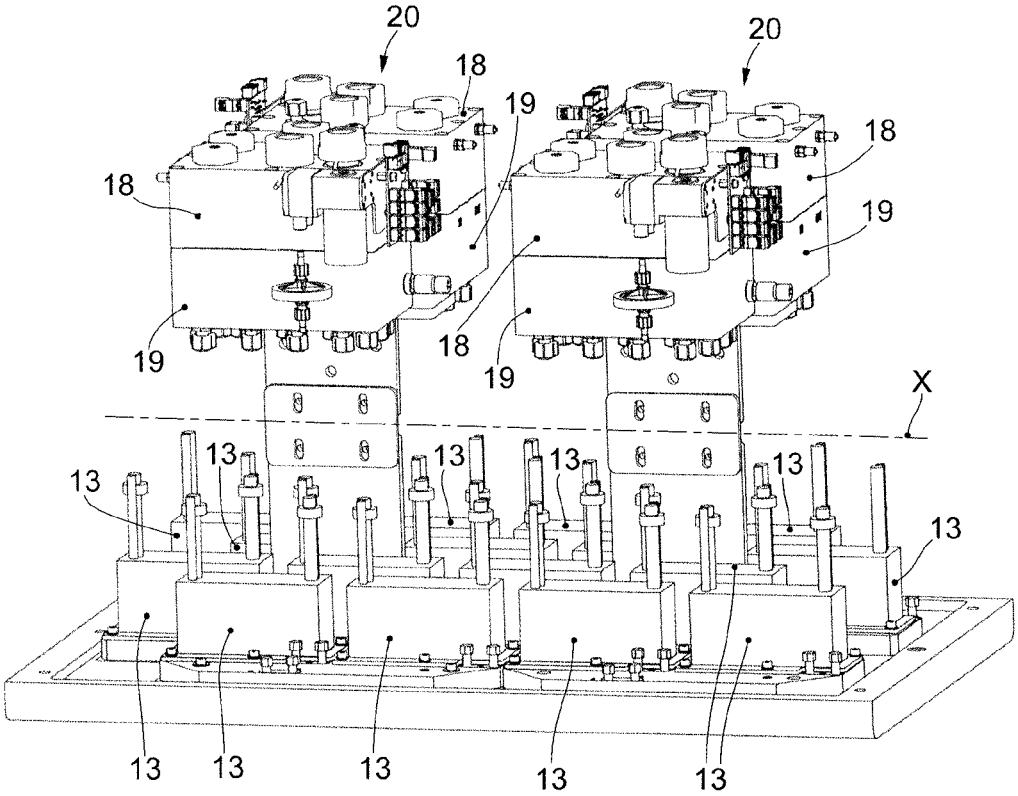
FIG. 2 is an axonometric view of a printing group.
Figure 3:
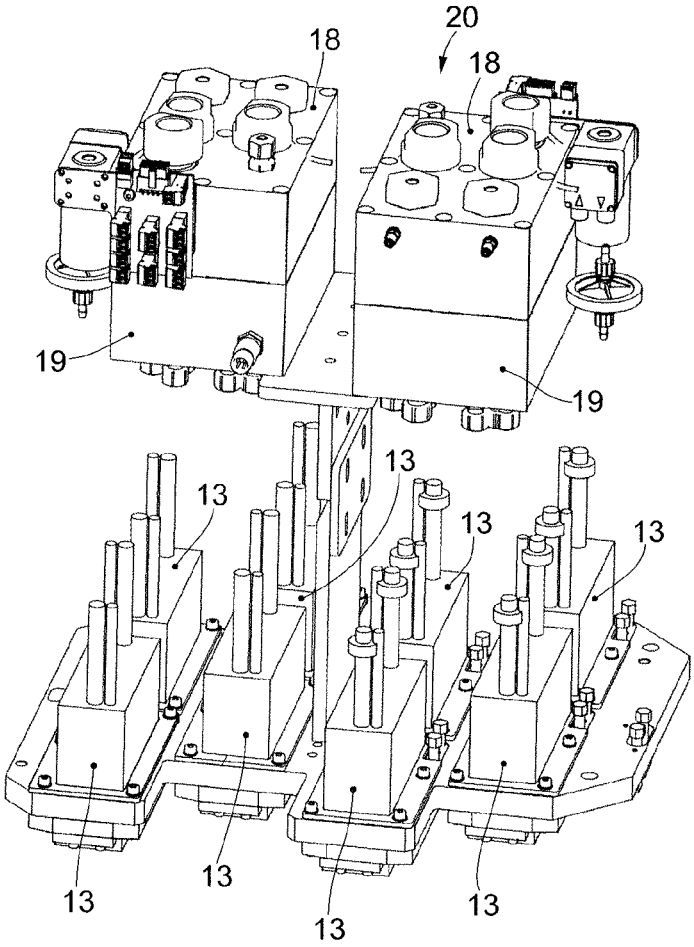
FIG. 3 is an axonometric view of a printing module.
Figure 4A:
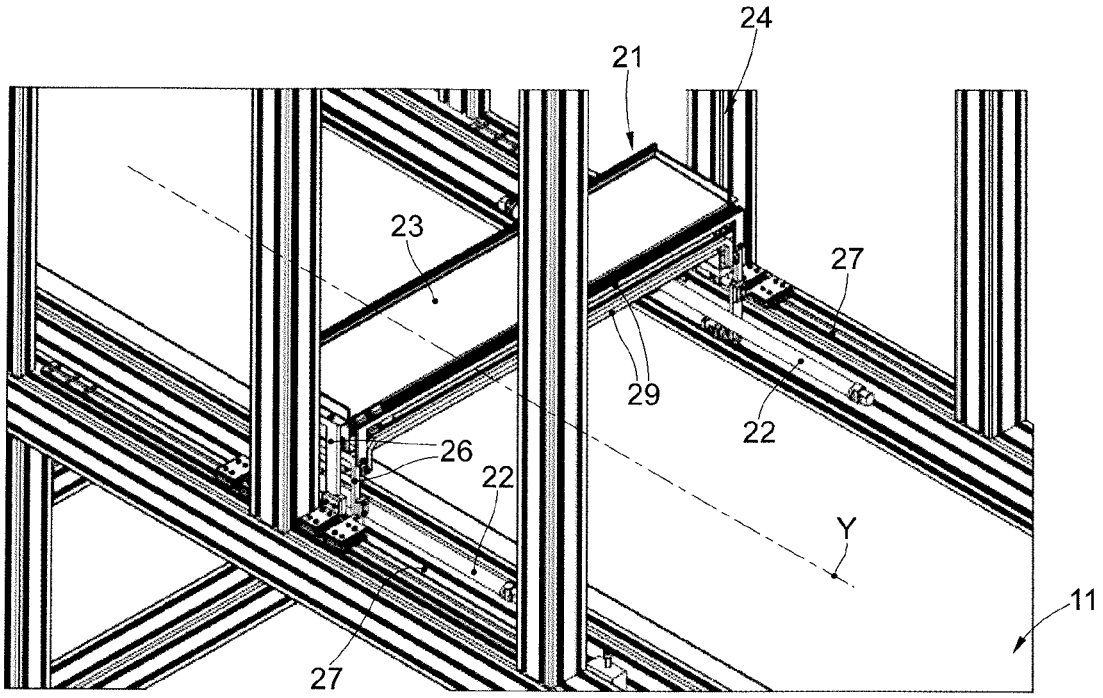
FIGS. 4A and 4B show details of the position of containment devices, with parts removed for better clarity.
Figure 4B:
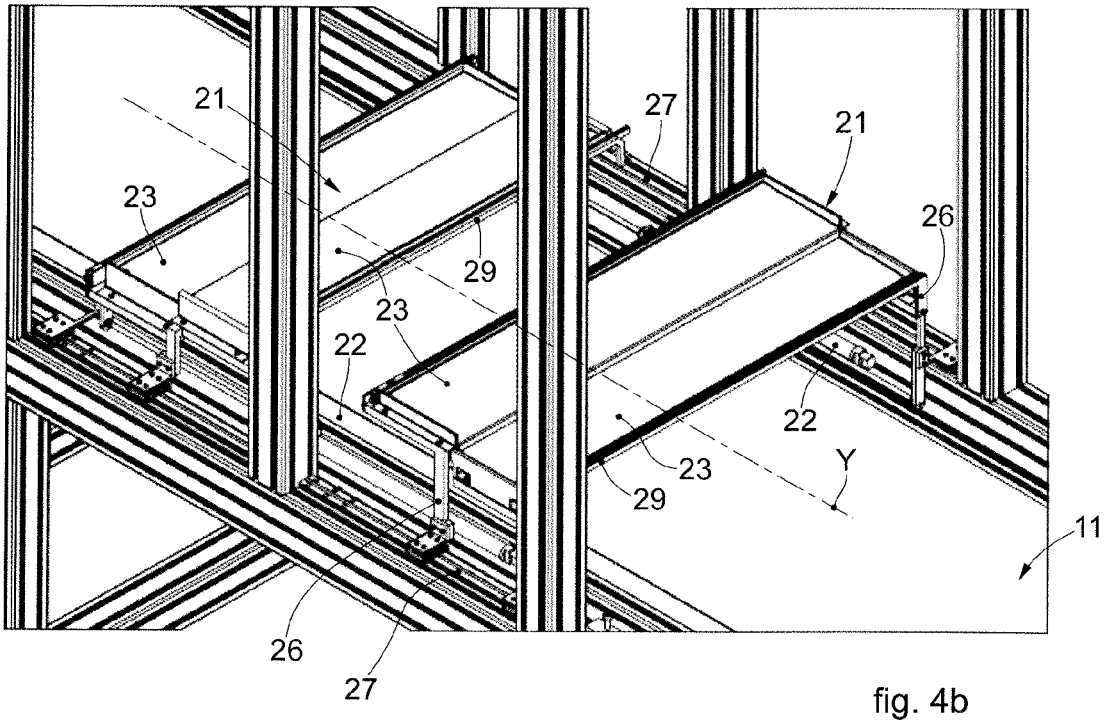
Figure 5:
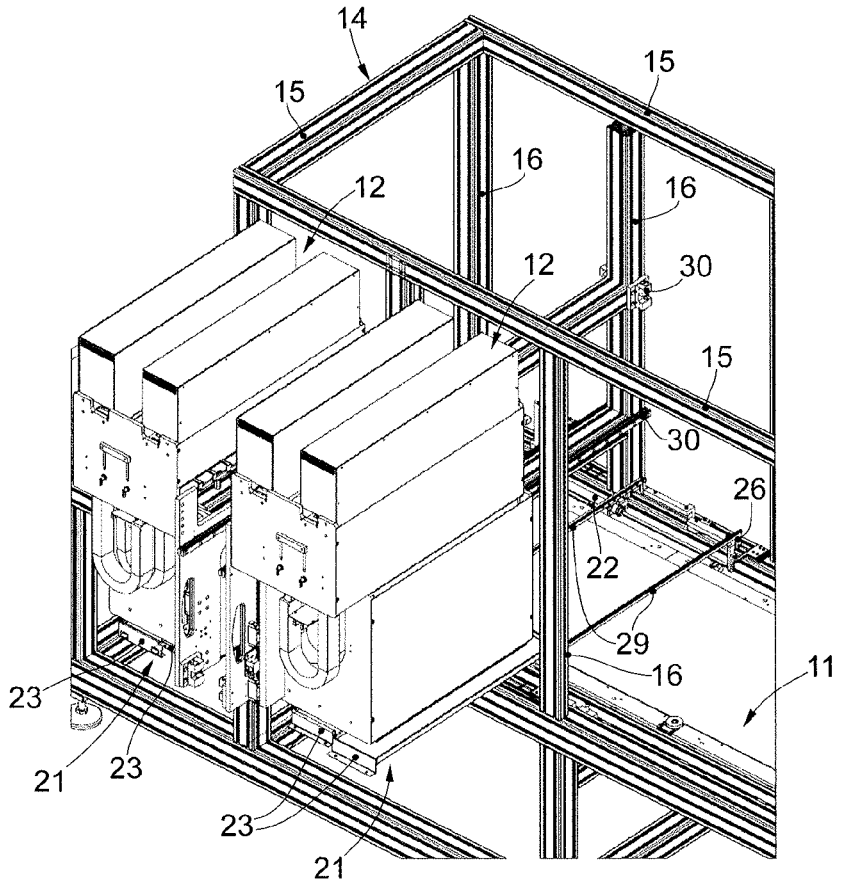
FIG. 5 is an axonometric view of a print bridge in service position, with parts removed for better clarity.
Figure 6:
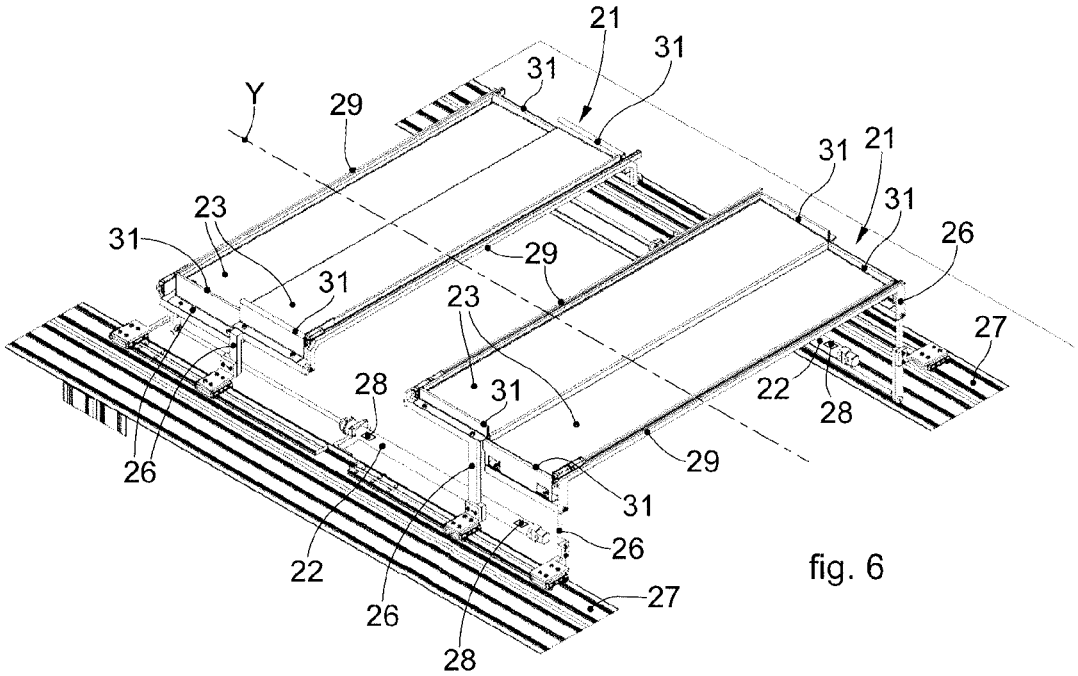
FIG. 6 is an axonometric view of containment devices with their moving system, with parts removed for better clarity.

According to a possible embodiment, illustrated for example in FIGS. 2 and 3, at least a tank 18, in the case in point two tanks 18, for the containment of the printing liquid, and at least a feed device 19 of the printing liquid, in the case in point at least two feed devices 19, i.e. one for each printing liquid, are associated to each printing group 12.

Each tank 18 contains a different type of printing liquid, e.g. a different primary color (cyan, magenta, yellow), a neutral color (black and white), as well as possible specific materials in order to confer, for example, shiny/opaque effects or also additives such as glitter.

Each feed device 19 takes from its respective tank 18 the printing liquid and feeds it to a plurality of printing heads 13.

According to the embodiment shown in FIG. 2, each printing group 12 can comprise at least a printing module 20, in the case in point two printing modules 20, each provided with a plurality of printing heads 13, in the case in point eight printing heads 13.

With reference to FIG. 2, the printing modules 20 are aligned to each other and, during use, are aligned according to an alignment axis X that is transverse to the longitudinal axis Y and to the moving direction Z.

The number of printing modules 20 is determined according to the required printing dimensions. As a matter of fact, placing a plurality of printing modules 20 one adjacent to the other, it is possible to define the width of print of the printing group 12.

With reference to FIG. 3, in which a unique printing module 20 is illustrated, the latter comprises two feed devices 19, each of which feeds a respective printing liquid to a predefined number of printing heads 13, in the case in point, four printing heads 13.

Each feed device 19 is connected on one side to its respective tank 18 that feeds the printing liquid, and on the other side to a plurality of printing heads 13, in the case in point four printing heads 13.

According to an aspect of the present invention, the printing apparatus 10 comprises at least two containment devices 21, namely at least a containment device 21 for each printing group 12, selectively placeable, through respective positioning means 22 at least in a first operative, or collecting, position, in which said containment device 21 is positioned under its respective printing group 12, and in a second inactive position, in which the containment device 21 is in a non-interfering condition with the movement of the printing head 13.

In particular, in the first operative, or collecting, position, the containment device 21 collects printing liquid leaking from the printing heads 13, while in the second inactive position the printing group 12 can be freely moved toward/away with respect to the support plane 11 and allow the printing.

According to a possible embodiment, at least two containment devices 21, of said printing groups 12, adjacent to each other, are placed on parallel and distanced lying planes, so that in their second inactive position they are superimposed to each other. Such embodiment allows to considerably reduce the dimension of the printing apparatus 10.

According to a possible embodiment, between at least two of said printing groups 12, a parking area 24 is provided, aligned with the longitudinal axis Y. In said parking area 24 at least one of the above-described containment devices 21 is placed in its second inactive position.

In possible embodiments, the parking area 24 is positioned in correspondence of two uprights 16 of the support structure 14, in a non-interfering position with the working of the printing heads 13.

According to a further embodiment, in the case that the parking area 24 is interposed between two printing groups 12, the containment devices 21 of both the printing groups 12 are positioned in said parking area 24 when they are in the second inactive position.

In a further embodiment, the positioning means 22 are configured to bring the containment devices 21 from the first active position to the second inactive position, or vice versa, moving them along the longitudinal axis Y and according to opposite movement directions. This solution allows to enhance the compactness of the printing apparatus 10 also in the case in which this embodiment is combined with the possibility of overlap the containment devices 21 with respect to each other.

According to a possible embodiment, each containment device 21 can comprise one or a plurality of trays 23, in the case in point two trays 23 (FIGS. 4A, 4B 6, 8 and 9) placed, at least in their first collecting operative position, adjacent to each other and configured to collect the printing liquid leaking from its respective printing group 12.

The two trays 23 (FIG. 4) are movable by the same positioning means 22 in their first collecting position and in their second inactive position. The presence of two trays 23 for each printing group 12 allows to widen the useful width of collection of the printing liquid from the printing apparatus 10.

According to possible embodiments, said trays 23 of each containment device 21 can be positioned on two parallel lying planes, and at least in their second inactive position are superimposed to each other. Such embodiment allows to reduce the space encumbered by said trays 23 in their second inactive position, therefore compacting the overall dimensions of the printing apparatus 10.

According to a possible embodiment, each containment device 21 can be supported by at least a support element 26 to which positioning means 22 are connected.

Said support element 26 can be moved along guiding elements 27, for example by means of sliding blocks, and with the action of the positioning means 22.

In particular, the guiding elements 27 are parallel to said longitudinal axis Y; the movement of support elements 26 on the guiding elements 27, by means of the positioning means 22, allows to carry the containment devices 21 in their first collecting operative position and in their second inactive position.

According to a possible aspect of the present invention, the positioning means 22 can be chosen from a group comprising at least one of linear actuators, articulated devices, belt drive mechanisms, endless screw mechanisms, linear motors or suchlike.

According to a possible solution of the present invention, the positioning means 22 can comprise at least pneumatic actuators and/or electric actuators.

According to possible embodiments, the positioning means 22 are configured to move the respective containment device 21 from its first collecting operative position to its second inactive position moving it in a direction that is parallel to said longitudinal axis Y.

According to a possible embodiment, the positioning means 22 are configured to move the respective containment device 21 from the first active position to the second inactive position by moving the containment device 21 only in a parallel direction with respect to said longitudinal axis Y.

According to a possible embodiment, the positioning means 22 can be provided with sensors 28, for example magnetic sensors, suitable for detecting the position of the positioning means 22 and therefore determine whether the containment device 21 is in its first collecting operative position or in its second inactive position.

According to possible embodiments of the present invention, at least the sensors 28 and positioning means 22 are connected to a non-illustrated control and command unit, configured to manage the positioning at least of the containment devices 21.

Moreover, the control and command unit can be connected to the moving devices 17, too, and can control their actuation in relation to the position taken by the containment devices 21.

According to a further embodiment of the present invention, to the support elements 26 of the containment devices 21 sliding guides 29 can be associated, configured to move the containment devices 21 from their first collecting operative position, to a third position, external to the support structure 14.

According to a possible embodiment, the sliding guides 29 are placed on a plane parallel to the support plane 11 and along a direction orthogonal to the longitudinal axis Y.

This allows to easily remove the containment devices 21, for example to allow their cleaning or their replacement.

According to possible embodiments, the printing groups 12 can be installed on guiding devices 30 positioned on a plane parallel to that of the support plane 11, and placed orthogonally to the longitudinal axis Y.

This allows to bring the printing groups 12 from a position lying above the support plane 11 to a position external to the support plane 11, wherein servicing can be performed.

Moreover, according to possible embodiments, the containment devices 21 can be provided with hooking portions 31 cooperating at least with a part of the respective printing group 12. In particular, in the first collecting operative position of the containment devices 21, one and/or the other of the printing groups 12 can be moved approaching the support plane 11 to hook to the hooking portions 31 of the respective containment device 21. In this way, at least when the printing groups 12 are moved along their guiding devices 30, also the containment devices 21 are translated with the printing groups 12. In this way, even during servicing of printing groups 12, the printing heads 13 are covered and the leaking of printing liquids is prevented.

It is worth noting that printing groups 12 are independent from each other, therefore one of the printing groups 12 can be extracted while the other printing group 12 continues to print. For example, some of the containment devices 21 could be in their first collecting operative position, under their respective printing group 12, while the other containment devices 21 are in their second inactive position and their respective printing groups 12 continue to print.

According to possible embodiments, said containment devices 21 (FIGS. 7A and 7B) are provided with seals 32 along the perimeter of each tray 23.

In alternative, or in combination, said seals 32 can be associated to each printing head 13, and the cooperation with the containment device 21 ensures the sealing.

Figure 7A:
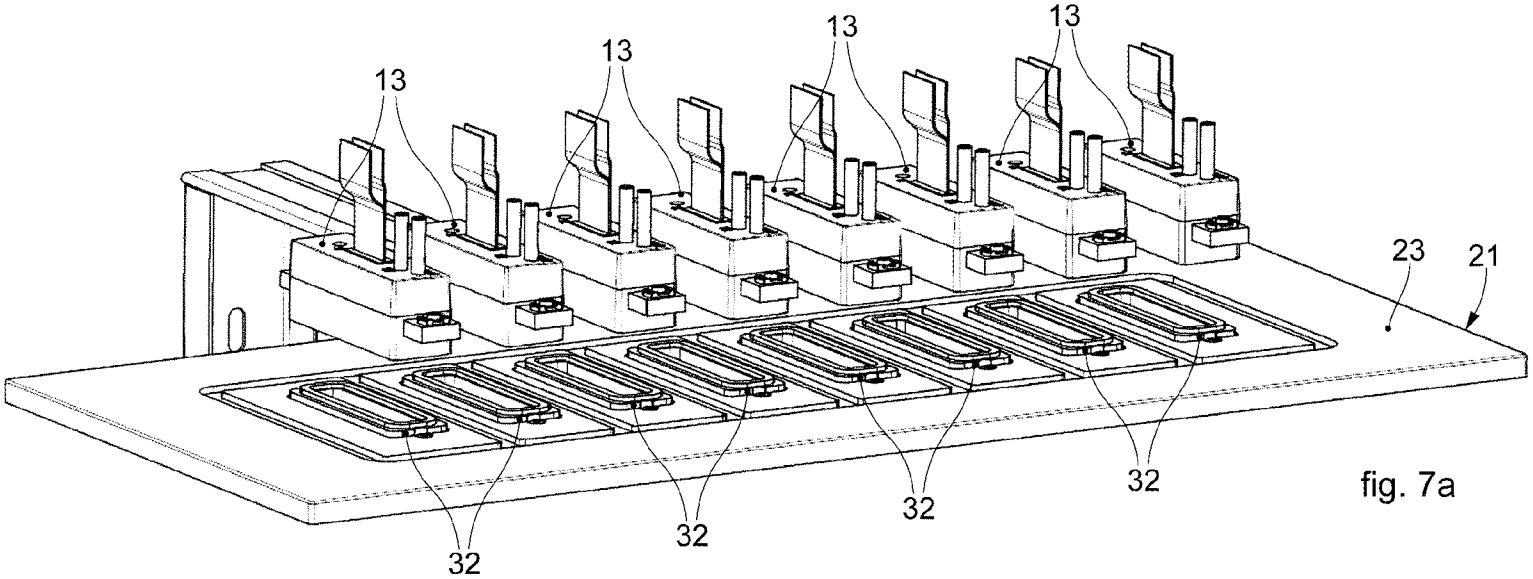
FIGS. 7A and 7B show axonometric views of a containment device for capping.
Figure 7B:
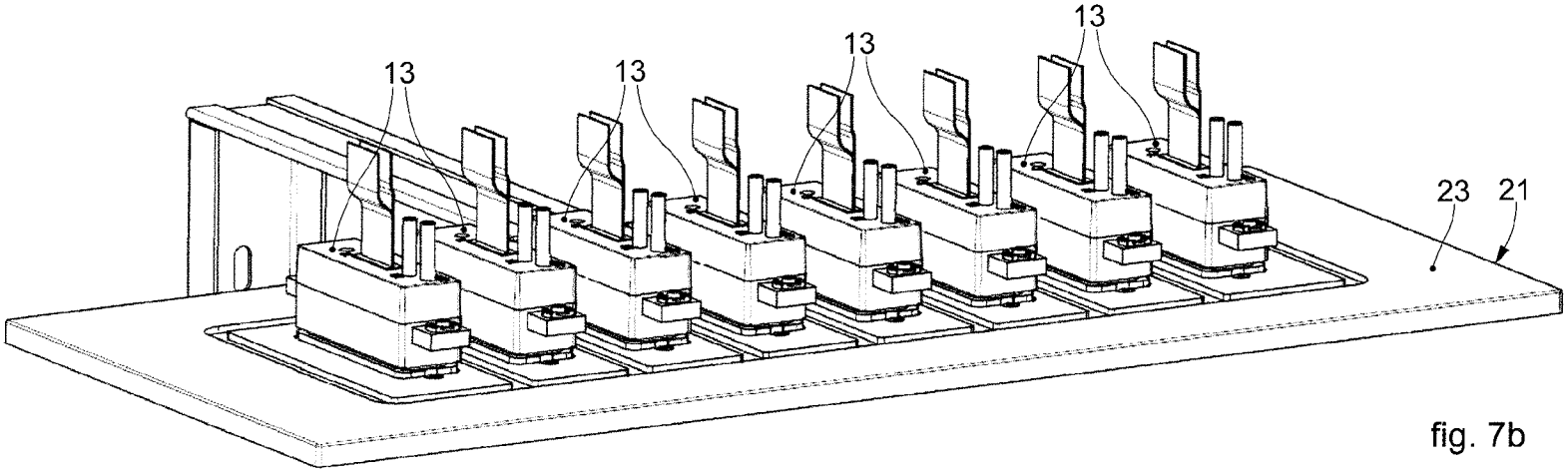

FIGS. 7A and 7B show the functioning of a capping tray 23: in a preferred embodiment, the tray 23 in the case in point has eight seals 32, one for each printing head 13. Initially said tray 23 is brought under the printing heads 13. In a second time, the printing group 12 is lowered so that the seals 32 in correspondence to each printing head 13 hermetically seal the printing heads 13 from the environment, so preventing air-sensitive printing liquid from evaporating or drying. As explained, the capping of a printing group 12 can occur independently for each printing group 12, so that while a printing group 12 is printing, another can undergo the flushing of the printing liquid inside the printing head 13 itself.

The invention claimed is:

1. A printing apparatus comprising:

a support plane to support at least a print support;

at least two printing groups aligned along a longitudinal axis, and each provided with at least a printing head;

a support structure provided to support said printing groups above said support plane, at least a moving device to move said printing groups towards/away with respect to said support plane, at least two containment devices each associated with respective positioning means, wherein said positioning means are configured to selectively move, independently with respect to each other and in a parallel direction with respect to said longitudinal axis, the respective containment device at least in a first operative position in which said containment device is positioned under said at least a printing head of one of said printing groups, and in a second inactive position in which said containment device is in a position not interfering with movement of said printing group towards or away with respect to said support plane wherein said containment devices are disposed on parallel and distanced lying planes and, in the second inactive position, said containment devices are superimposed to each other.

2. The printing apparatus as in claim 1, wherein in their second inactive position said containment devices are placed in an intermediate position between two adjacent printing groups.

3. The printing apparatus as in claim 1, wherein said positioning means are configured to bring said containment devices from the first active position, to the second inactive position, or vice versa, moving them along said longitudinal axis and according to opposite movement directions.

4. The printing apparatus as in claim 1, wherein said positioning means are configured to move the respective containment device from said first active position to said second inactive position by moving said containment device only in a parallel direction with respect to said longitudinal axis.

5. The printing apparatus as in claim 1, wherein between said two printing groups there is provided a parking area, aligned to said longitudinal axis, and wherein at least one of said containment devices is parked, at least in said second inactive position.

6. The printing apparatus as in claim 1, wherein said containment device comprises a plurality of trays placed, at least in their first operative position, adjacent to each other, and configured to collect the printing liquid of their respective printing group.

7. The printing apparatus as in claim 6, wherein said trays of each containment device are positioned on two parallel lying planes, and, at least in said inactive position, are superimposed to each other.

8. The printing apparatus as in claim 1, wherein each containment device is supported by at least a support element to which positioning means are connected, and to said support element sliding guides are associated, configured to move said containment devices (21) from their first operative position to a third position external to said support structure.

9. The printing apparatus as in claim 1, wherein at least one among said containment devices and said printing heads is provided with seals.

* * * * *